US005418513A

United States Patent [19]

Fujisawa et al.

[11] Patent Number: 5,418,513

[45] Date of Patent: May 23, 1995

[54] TRANSFORMER CORE IN TRANSFORMER CIRCUIT

[75] Inventors: Shigeo Fujisawa, Tokyo; Kazuhiko Marumo; Takashi Moribayashi, both of Kanagawa, all of Japan

[73] Assignee: Stanley Electric Co. Ltd., Tokyo, Japan

[21] Appl. No.: 118,789

[22] Filed: Sep. 10, 1993

Related U.S. Application Data

[63] Continuation of Ser. No. 862,629, Apr. 1, 1992, abandoned.

[30] Foreign Application Priority Data

Apr. 3, 1991 [JP] Japan ..... 3-029385 U

[51] Int. Cl.[6] ..... H01F 27/30

[52] U.S. Cl. ..... 336/178; 336/198; 336/212; 336/234

[58] Field of Search ..... 336/198, 178, 212, 234, 336/165, 208, 216; 323/355

[56] References Cited

U.S. PATENT DOCUMENTS

| | | | |
|---|---|---|---|
| 2,806,199 | 10/1957 | Sola | 336/165 |
| 3,354,417 | 11/1967 | Davis | 336/198 |
| 3,457,635 | 7/1969 | Michiulis | 336/212 |
| 3,461,758 | 8/1969 | Michiulis | 336/212 |
| 3,491,437 | 1/1970 | Small | 336/212 |
| 4,887,061 | 12/1989 | Matsumura | 336/178 |
| 4,945,332 | 7/1990 | Sakamoto | 336/198 |

FOREIGN PATENT DOCUMENTS

| | | | |
|---|---|---|---|
| 1056728 | 5/1959 | Germany | 336/178 |

*Primary Examiner*—Thomas J. Kozma
*Attorney, Agent, or Firm*—Nixon & Vanderhye

[57] ABSTRACT

A transformer core assembly in a transformer comprises a coil having a primary winding and a secondary winding which are successively wound about a hollow coil bobbin, in division, with respect to a longitudinal direction of the hollow coil bobbin, and a pair of E-type cores in which central core sections of respective three core sections extending in parallel relation to each other are inserted respectively from both ends of the coil bobbin into a hollow section therewithin. The core sections of one of the pair of E-type cores have lengths thereof which are formed shorter than lengths of the core sections of the other E-type core. When the central core sections are inserted respectively into the hollow section within the coil bobbin, so-called core gaps defined such that the core sections have respective forward ends thereof which are abutted against each other are located within an area corresponding to the primary winding of the coil bobbin.

7 Claims, 1 Drawing Sheet

TRANSFORMER CORE IN TRANSFORMER CIRCUIT

This is a continuation of application Ser. No. 07/862,629, filed Apr. 1, 1992, now abandoned.

BACKGROUND OF THE INVENTION

The present Invention relates to a transformer core assembly in an inverter transformer for a cold cathode tube, which comprises a coil bobbin about which a primary winding and a secondary winding of the transformer are wound, and a pair of transformer cores to be inserted into a hollow section within the coil bobbin.

Conventionally, a transformer of the kind referred to above is arranged as, for example, in FIG. 3 of the attached drawings.

In FIG. 3, a transformer 1 comprises a coil bobbin 2 formed into a hollow configuration, a coil 5 having a primary winding 3 and a secondary winding 4 which are successively wound respectively about a pair of winging sections 2*a* and 2*b* provided in division with respect to a longitudinal direction of the coil bobbin 2, and a pair of E-type cores 6 and 7 having the same shape or configuration in which central core sections 6*a* and 7*a* of respective three (3) core sections 6*a*, 6*b* and 6*c* and 7*a*, 7*b* and 7*c* extending in parallel relation to each other are inserted respectively from both ends of a hollow section 2*c* within the coil bobbin 2 into the same.

According to the transformer constructed as described above, the core sections 6*a*, 6*b* and 6*c* of the E-type core 6 have respective forward ends thereof which are abutted respectively against the core sections 7*a*, 7*b* and 7*c* of the E-type core 7, thereby forming core gaps G, and the magnetic fluxes generated due to the primary winding 3 reach the secondary winding 4 through magnetic paths which extend respectively from the core sections 6*a*, 6*b* and 6*c* of the E-type core 6 to the core sections 7*a*, 7*b* and 7*c* of the E-type core 7 through the core gaps G. In like manner, the magnetic fluxes generated due to the secondary winding 4 reach the primary winding 3 through magnetic paths which extend respectively from the core sections 7*a*, 7*b* and 7*c* of the E-type core 6 to the core sections 6*a*, 6*b* and 6*c* of the E-type core 6 through the core gaps G. Thus, when voltage is applied to the primary winding 3, current flows through the secondary winding 4 to which a load is connected.

The transformer 1 constructed in this manner, however, has the following problems. That is, since the magnetic paths are spaced from each other respectively by the core gaps G, it is impossible that the magnetic fluxes pass 100% at portions of the respective core gaps G, and enter the opposite core sections so that parts of the magnetic fluxes leak to the air. Thus, a transmitting efficiency from the primary side to the secondary side is reduced. Particularly, since the E-type cores 6 and 7 are the same in shape or configuration as each other, the core gaps G are fixed substantially at a center of the coil bobbin 2 with reference to a longitudinal direction thereof. In many cases, the core gaps G are arranged at a location corresponding to the secondary winding. Accordingly, as magnetic fluxes generated by a magnetomotive force of the secondary winding leak into the air by the core gaps G, the magnetic fluxes are not interlinked with the primary winding, whereby an output efficiency of the transformer 1 is reduced. Thus, voltage produced by the secondary winding is reduced, and the starting ability of the inverter for the cold cathode tube is reduced.

SUMMARY OF THE INVENTION

It is an object of the invention to provide a transformer core assembly in which a transmitting efficiency from a primary side to a secondary side is raised to improve an output efficiency, whereby there is produced higher voltage at the secondary side, and the starting ability of an inverter for a cold cathode tube is improved.

According to the invention, there is provided a transformer core assembly in a transformer which comprises a coil having a primary winding and a secondary winding which are successively wound about a hollow coil bobbin, in division, with respect to a longitudinal direction of the hollow coil bobbin, and a pair of E-type cores in which central core sections of respective three core sections extending in parallel relation to each other are inserted respectively from both ends of the coil bobbin into a hollow section therewithin, wherein the core sections of one of the pair of E-type cores have lengths thereof which are formed shorter than lengths of the core section of the other E-type core, and wherein, when the central core sections are inserted respectively into the hollow section within the coil bobbin, so-called core gaps defined such that the core sections have respective forward ends thereof which are abutted against each other are located within an area corresponding to the primary winding of the coil bobbin.

With the above arrangement of the invention, the forward ends of the respective core sections of one of the E-Type cores are abutted in opposed relation respectively to the forward ends of the respective core sections of the other E-type core. Therefore, the magnetic fluxes generated by the primary winding reach the side of the secondary winding through the magnetic paths extending from the core sections of the one E-type core to the core sections of the other E-type core through the core gaps. In like manner, the magnetic fluxes generated by the secondary winding reach the side of the primary winding through the magnetic paths extending from the core sections of the one E-type core to the core sections of the other E-type core through the core gaps.

At that time, since the core gaps are located at the area of the primary winding, even if the magnetic fluxes leak into the air through the core gaps, the leaking magnetic fluxes are apt to be interlinked with the primary winding. Thus, reduction of the transmitting efficiency at the time of passing through the core gaps can be restrained.

Accordingly, the output efficiency of the transformer is improved, there is produced a relatively high secondary voltage, and the starting ability of the inverter for the cold cathode tube is improved.

DETAILED DESCRIPTION OF THE DRAWINGS

DESCRIPTION OF THE EMBODIMENTS

Figure 1:
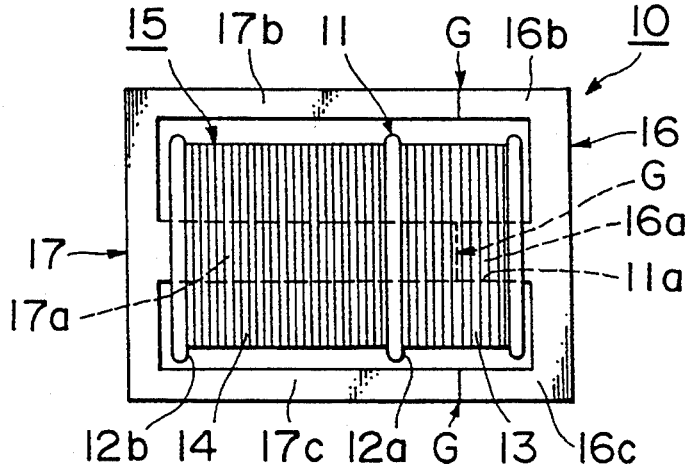
FIG. 1 is a schematic plan view showing an embodiment of a transformer in which a transformer core according to the invention is incorporated.

FIG. 1 shows an embodiment of a transformer into which a transformer core assembly according to the invention is incorporated.

As shown in FIG. 1, a transformer 10 comprises a coil bobbin 11 formed into a hollow configuration, a coil 15 having a primary winding 13 and a secondary winding 14 which are sucessively wound respectively about a pair of winding sections 12*a* and 12*b* provided in division with reference to a longitudinal direction of the coil bobbin 11, and a pair of E-type cores 16 and 17 in which central core legs or sections 16*a* and 17*a* of respective three (3) core legs or sections 16*a*, 16*b* and 16*c* and 17*a*, 17*b* and 17*c* which extend in parallel relation to each other are to be inserted from both ends of a hollow section 11*a* within the coil bobbin 11 into the same.

Figure 3:
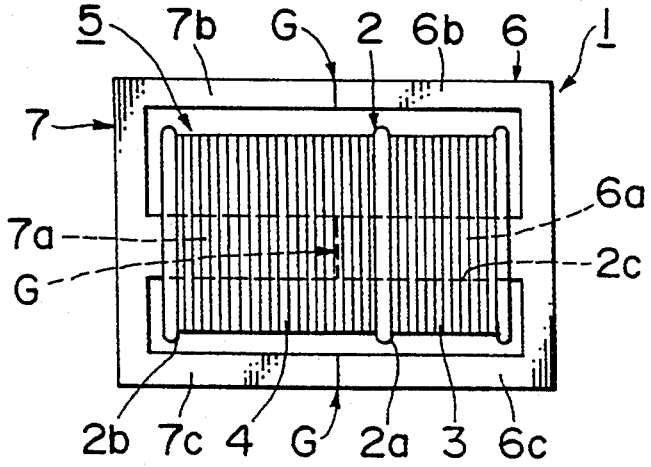
FIG. 3 PRIOR ART
FIG. 3 is a schematic plan view showing an example of a conventional transformer into which a transformer core is incorporated.

The arrangement described above is substantially similar to that of the conventional transformer 1 illustrated in FIG. 3. In the transformer 10 according to the invention, however, the E-type core 16 is formed such that its core sections 16*a*, 16*b* and 16*c* have respective lengths thereof which are shorter than those of the E-type cores 17*a*, 17*b* and 17*c* of the E-type core 17.

The transformer 10 according to the invention is arranged as described above. Accordingly, when the E-type cores 16 and 17 are inserted into the hollow section 11*a* within the coil bobbin 11, the core sections 16*a*, 16*b* and 16*c* of the E-type core 16 have respective forward ends thereof which are abutted respectively against the core sections 17*a*, 17*b* and 17*c* of the E-type core 17, whereby core gaps G are defined. At this time, the core gaps G are located at an area of the primary coil 13 which is wound about the winding section 12*a* of the coil bobbin 11 adjacent to the E-type core 16, because the core sections 16*a*, 16*b* and 16*c* of the E-type core 16 are respectively shorter than the core sections 17*a*, 17*b* and 17*c* of the E-type core 17. Thus, when a part of magnetic fluxes generated by the secondary winding 14 reaches the side of the primary winding 13 from the core sections 17*a*, 17*b* and 17*c* of the E-type core 17 through the core gaps G along the magnetic paths extending toward the core sections 16*a*, 16*b* and 16*c* of the E-type core 16, even if the magnetic fluxes leak into the air from the core sections 16*a*, 16*b* and 16*c* of the E-type core 16, since the core gaps G are located at the area of the primary coil 13, the above-described leaking magnetic fluxes are apt to be interlinked with the primary coil 13. Accordingly, reduction of the transmitting efficiency at the time of passing through the core gaps G can be restrained.

Thus, when voltage is applied to the primary winding 13, current flows through the secondary winding 14 to which a lead is connected, at a high output efficiency. In the Transformer 10, its output efficiency is improved, and there is produced relatively high secondary voltage. Further, the starting ability of the inverter for the cold cathode tube is improved.

Figure 2:
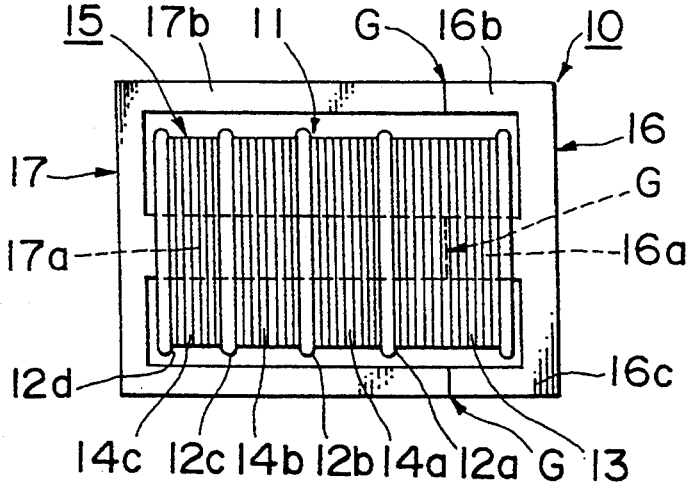
FIG. 2 is a schematic top view showing another embodiment of the invention.

FIG. 2 shows another embodiment of a transformer which is provided with a transformer core assembly according to the invention. It is to be noted that like or similar reference numerals are applied to components and parts .the same or identical with those illustrated in FIG. 1. In the another embodiment, there are provided winding sections 12*a*, 12*b*, 12*c* and 12*d* into which a coil bobbin 11 is divided, along a longitudinal direction thereof. A primary winding 13 is wound about the winding section 12*a*, while three (3) secondary windings 14*a*, 14*b* and 14*c* are wound respectively about the winding sections 12*b*, 12*c* and 13*d*. Except for the above, the embodiment illustrated in FIG. 2 is similar in arrangement to the embodiment Illustrated in FIG. 1. Function of the embodiment shown in FIG. 2 is also similar to the embodiment illustrated in FIG. 1.

What is claimed is:

1. A transformer circuit comprising:

a power supply;

a load; and a transformer including: hollow coil bobbin having a primary winding section divided from a secondary winding section;

a coil having a primary winding connected to said power supply and a secondary winding connected to said load, said primary and secondary windings being successively wound about said hollow coil bobbin in said primary winding section and said secondary winding section, respectively; and a first E-shaped core having three elongated parallel core legs and a second E-shaped core having three shortened parallel core legs which are shorter than said elongated core legs, each with a center core leg inserted into one end of said hollow coil bobbin, wherein ends of said three elongated parallel core legs for said first E-shaped core meet at an abutting substantially flat joint against corresponding ends of said three shortened parallel core legs for said second E-shaped core within said primary winding section of said hollow coil bobbin such that magnetic fluid leaking at the abutting joint of said elongated and shortened cores interlinks with the primary winding to minimize the effects of the flux leakage on the efficiency of said transformer.

2. A transformer circuit according to claim 1 wherein said secondary winding is formed by a single winding.

3. A transformer circuit according to claim 1 wherein said secondary winding is formed by a plurality of windings.

4. A transformer circuit according to claim 1, wherein said transformer is an inverter transformer for a cold cathode tube.

5. A transformer circuit according to claim 1, wherein three parallel said core legs of said first E-shaped core are substantially the same length and wherein said three parallel core legs of said second E-shape core are substantially the same length.

6. A transformer circuit according to claim 1, wherein said secondary winding section includes a plurality of divided winding sections.

7. The transformer circuit according to claim 1, wherein the ends of the first and second E-shaped cores are substantially flat surfaces.

* * * * *